US006454130B1

(12) United States Patent
Miller et al.

(10) Patent No.: US 6,454,130 B1
(45) Date of Patent: Sep. 24, 2002

(54) MULTICHANNEL DISPENSING CLOSURE

(75) Inventors: Christopher Joseph Miller, Flemington; Scott Murray Walsh, Flanders, both of NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 09/969,321

(22) Filed: Oct. 3, 2001

(51) Int. Cl.[7] ..... B65D 35/22
(52) U.S. Cl. ..... 222/94; 222/145.3; 222/556
(58) Field of Search ..... 222/94, 107, 132, 222/145.3, 563, 478, 556; 425/183, 191

(56) References Cited

U.S. PATENT DOCUMENTS 4,964,539 A * 10/1990 Mueller ..... 222/94
5,941,420 A * 8/1999 Connan ..... 222/94
5,954,234 A * 9/1999 Connan et al. ..... 222/94
6,257,450 B1 * 7/2001 Jackson et al. ..... 222/94
6,308,862 B1 * 10/2001 Fillmore et al. ..... 222/94

* cited by examiner

*Primary Examiner*—Lesley D. Morris
*Assistant Examiner*—Stephanie L Willatt
(74) *Attorney, Agent, or Firm*—Michael J. McGreal

(57) ABSTRACT

A closure for a multi-chamber container can have a flow director device that will assist in the dispensing of the products from the multi-chamber tube in a number of product streams that are greater than the number of chambers in the container. This provides versatility in the dispensing of products from such tubes. By the use of several different closures with different flow patterns different products can be delivered in a number of patterns form the same container.

20 Claims, 6 Drawing Sheets

MULTICHANNEL DISPENSING CLOSURE

FIELD OF THE INVENTION

This invention relates to the dispensing of a product from a tube container that has at least two chambers in streams greater than the number of chambers. More particularly, this invention relates to the dispensing of products from a multichamber tube in multiple streams of more than the number of chambers where the closure contains a flow director to flow the product in such multiple streams.

BACKGROUND OF THE INVENTION

There are various types of multichamber tube containers. These are usually of the type where the products are in a side-by-side longitudinal relationship or are located concentrically, one inside of another. The former type of a tube is shown in U.S. Pat. No. 1,894,115; U.S. Pat. No. 3,227,319; U.S. Pat. No. 3,506,159; and U.S. Pat. No. 4,089,437 and the latter type of a tube is shown in U.S. Pat. No. 1,699,532; U.S. Pat. No. 2,939,610 and U.S. Pat. No. 4,211,341. These primarily are dual chamber tubes that will dispense the products in the tubes in the same array in which they are in the tubes. That is, the tubes where two products are disposed in a side-by-side longitudinal relationship usually will dispense the products in two D-shaped streams, and the tubes where two products are in a concentric relationship usually will dispense the product in two concentric circles. An objective of this patent is to provide a way to flow the products from a dual chamber tube where the products are in a side-by-side longitudinal relationship in other than two D-shaped streams.

It is desired many times to improve the aesthetics of a product that is being dispensed from a dual chamber tube. As noted this will be in the form of two D-shaped streams of a tube container that has the products in a longitudinal side-by-side orientation. This was addressed in U.S. Pat. No. 5,941,420 where two streams from such a dual chamber tube are flowed in up to four different streams. This is accomplished by a flow director in the nozzle of a tube and which is a part of the shoulder of the tube. The flow director in this instance is attached directly to the center divider wall of the tube. A closure then is placed over the nozzle. Such a closure will have an unobstructed cylindrical path for the flow of the product from the nozzle.

A disadvantage in having the flow director as a part of the nozzle is that the tube making process and equipment then must be modified. The processes and equipment would have to be changed for each arrangement of product flow from the tube. This is burdensome and costly. During changeovers the tube making equipment is not being used.

It has been found that a flow director for the flow of two streams into a plurality of streams can be made a part of the closure and need not be a part of the tube shoulder. In this way the same tube can be used to produce many different product streams. Also it is more efficient to have an inventory of closures with different flow directors than tubes with different flow directors. In this regard this invention is an improvement over the multichamber tubes of U.S. Pat. No. 5,941,420.

BRIEF DESCRIPTION OF THE INVENTION

The present invention is directed to a multi-channel closure for delivering products from a multichamber tube. The closure includes in a base portion a flow director for receiving the flow of products from each of the chambers of the multichamber tube and to deliver the products through the base portion of the closure in an array of segments greater than the number of tube chambers. The multichamber tube will have at least two longitudinal chambers with each chamber dispensing a product through the tube shoulder to a nozzle exit. The closure is attached to the exit of the tube nozzle with a first chamber of the tube delivering a first product to a first set of channels of said closure and a second chamber of the tube delivering a second product to a second set of channels of said closure. The first product and the second products then are delivered from the base portion of the closure to a point of use.

The flow director in the closure is such that each set of channels will receive a product from a chamber of the tube. There is a sufficient seal between the closure and the tube so that there is no mixing of the product from one chamber with that from another chamber until the exit from the base portion of the closure.

DETAILED DESCRIPTION OF THE INVENTION

The invention will be described in detail with reference to the drawings. The drawings show a preferred embodiment of the invention with variations being within the scope of the present invention.

Figure 1:
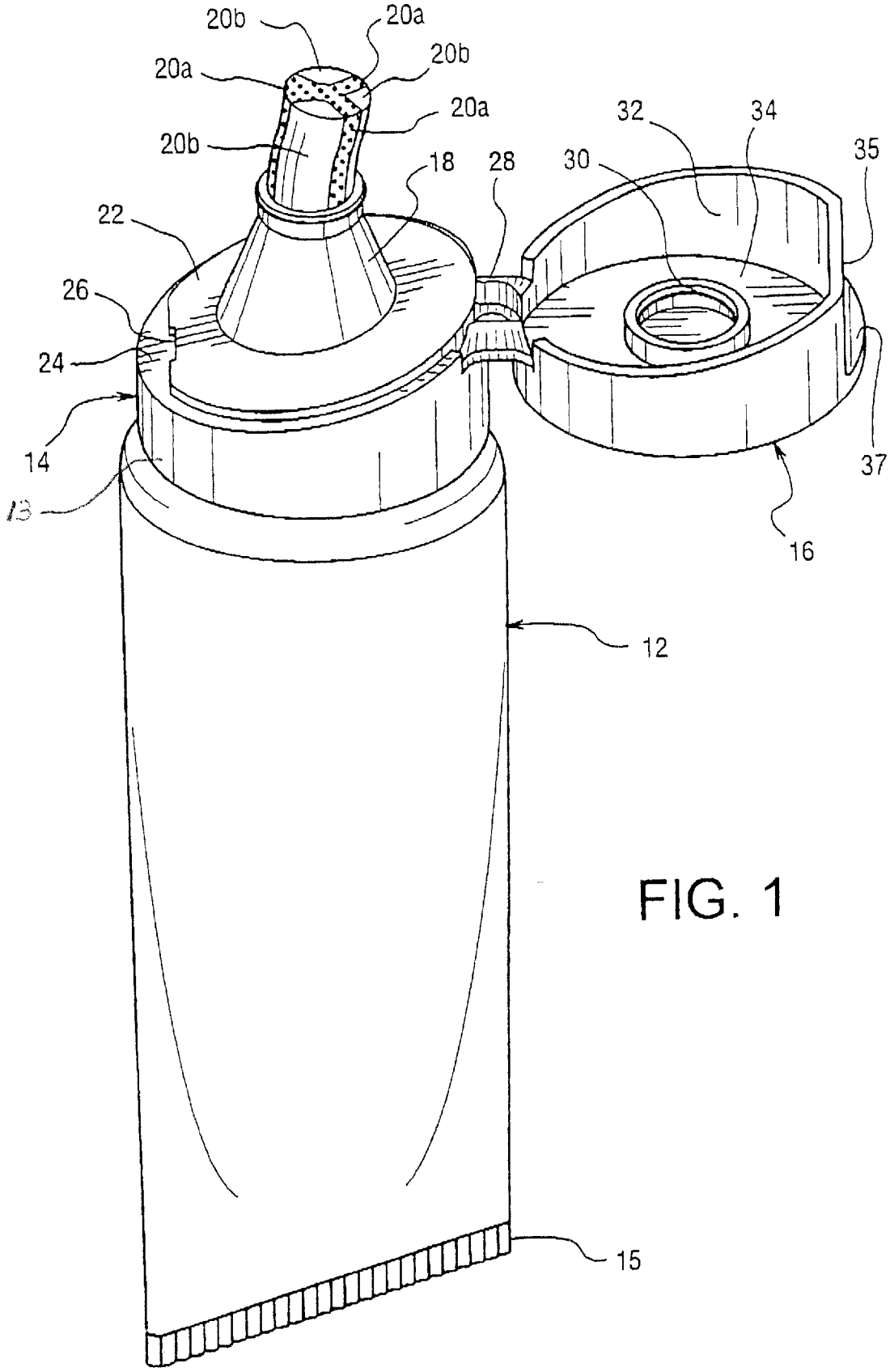
FIG. 1 is an elevational view of the dual chamber tube with closure showing six different peripheral product streams.

FIG. 1 shows tube 12 with a top closure 14 and a lower crimp seal 15. This tube is a dual chamber tube that has two longitudinal side-by-side chambers. A divider wall 36 (FIG. 3) extends from the top of the tube to the crimp seal. The closure 14 has a flow director 55 (FIG. 5) which will flow the two products in the tube in a plurality of segments as shown in the dispensed products 20(*a*) and 20(*b*). These products 20(*a*) and 20(*b*) are shown in six segments.

The closure 14 is comprised of base 13 and lid 16. The base has a nozzle 18 extending from deck 22. This deck has a peripheral area 24 to accept the edge of wall 32 of lid 16. A part of the lid latching mechanism is shown at 26. Hinge 28 connects the lid to the base. This usually will be a living hinge. The lid also has recessed wall 35 which provides ledge 37 to assist in opening the closure. Incorporated into the lid is seal 30 on lid top wall 34 to seal the nozzle 18 of the base 13 when the lid is closed.

Figure 2:
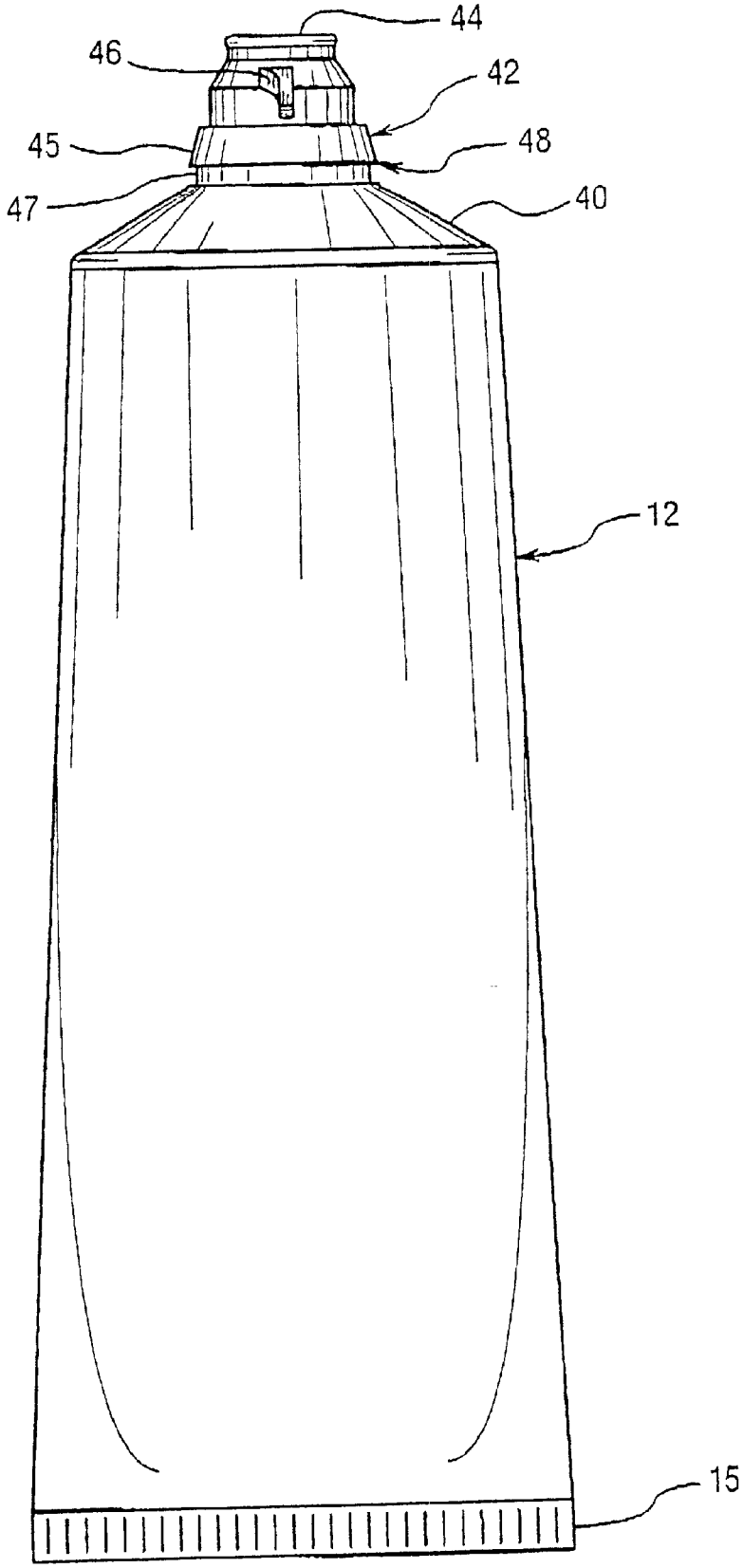
FIG. 2 is an elevational view of the tube of FIG. 1 with the closure removed.

FIG. 2 shows the tube of FIG. 1 with the closure removed. This shows the tube shoulder 40 and tube nozzle 42. The tube nozzle has an exit 44 and orienting recesses 46 which mate with orienting projections 50 on the closure. As an alternative the tube nozzle can have orienting projections, and the closure orienting recesses. Also a part of the tube nozzle is closure locking mechanism 48. This consists of frustoconical wall 45 and recess 47 below this wall which functions as a locking ridge.

Figure 3:
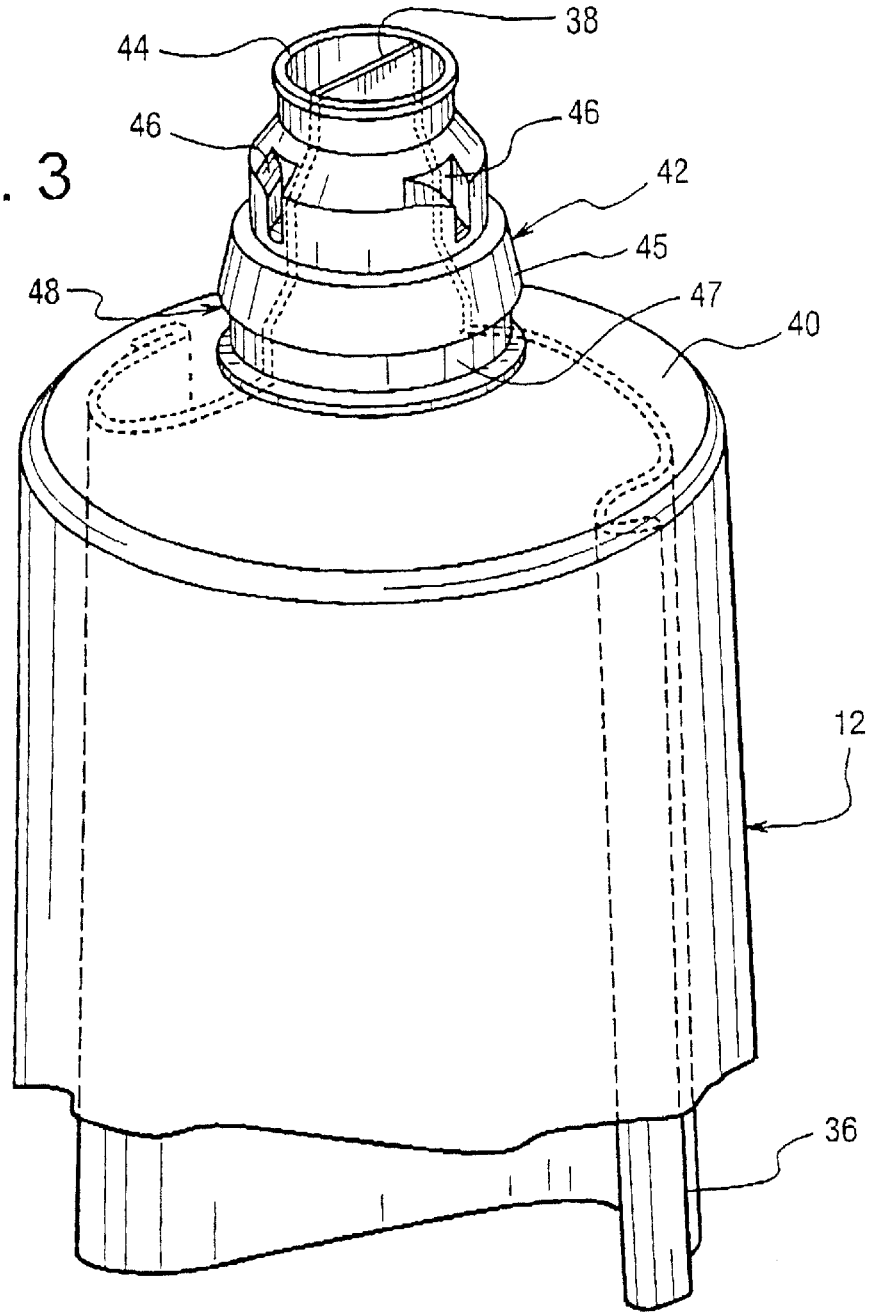
FIG. 3 is an expanded view of the upper part of the tube of FIG. 2 showing the internal tube dividing wall.
Figure 4:
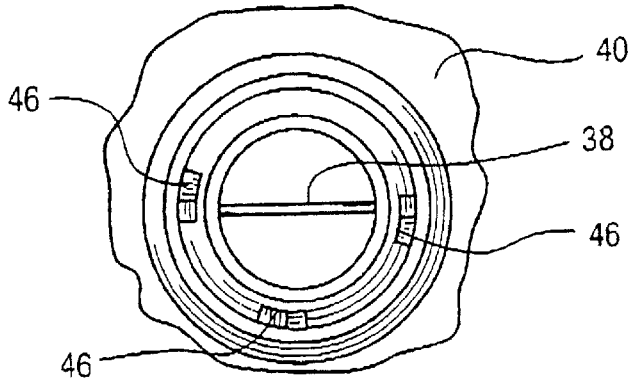
FIG. 4 is a top plan view of the tube of FIG. 3 showing the nozzle exit.

FIG. 3 shows the relationship of the tube chambers to the tube nozzle and tube nozzle exit. Tube longitudinal wall 36 extends up and into the tube nozzle 42 to form tube nozzle divider wall 38. This extends to about the exit 44 of tube nozzle 42. Depending on the structure of the closure this can be recessed in the nozzle, of equal height, or extend beyond the nozzle. The net result of this structure are separate chambers up through about the tube exit. Also shown in this view are two of the orienting recesses 46. The structure of the tube nozzle exit is shown in more detail in FIG. 4 which shows a third orienting recess 46. One such recess is sufficient, but with a plurality of recesses being preferred in automated packaging systems.

Figure 5:
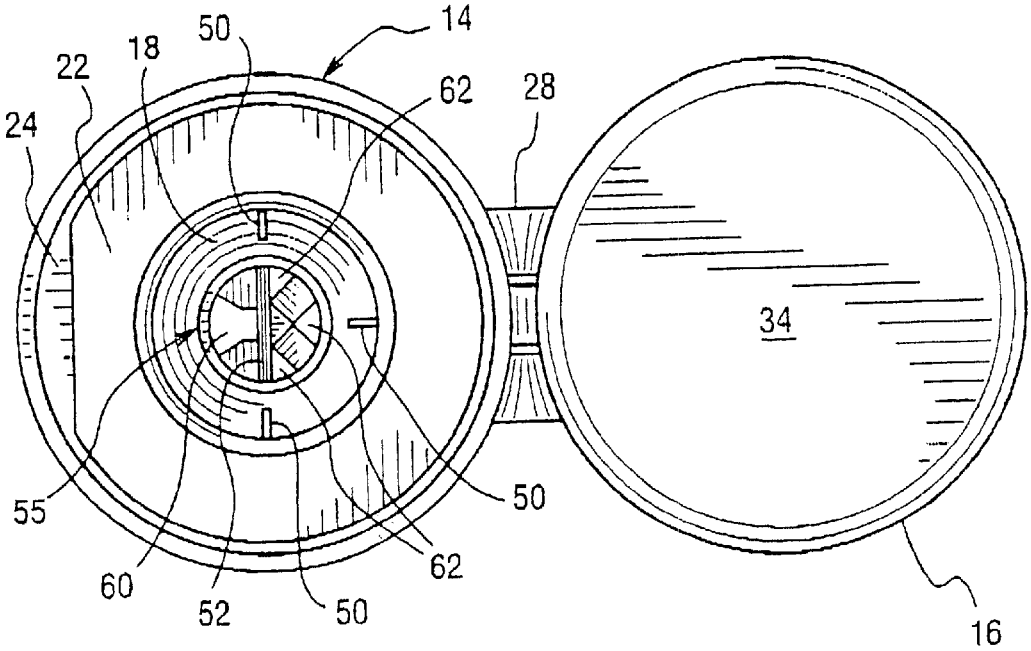
FIG. 5 is a bottom plan view of the closure of FIG. 1

FIG. 5 shows a bottom plan view of closure 14. This view shows the underside of deck 22, peripheral seal area 24, hinges 28 and lid 16 top wall 34. Also shown in this view are orienting closure projections 50 that will mate with recesses 46 on the tube nozzle. In the alternative the projections can be on the tube. The divider wall 52 of the closure will seal with nozzle divider wall 38 so that the product streams do not mix until exiting the closure. The flow director 55 has channels 60 to deliver product 20(*a*) and channels 62, product 20(*b*) (FIG. 1).

Figure 6:
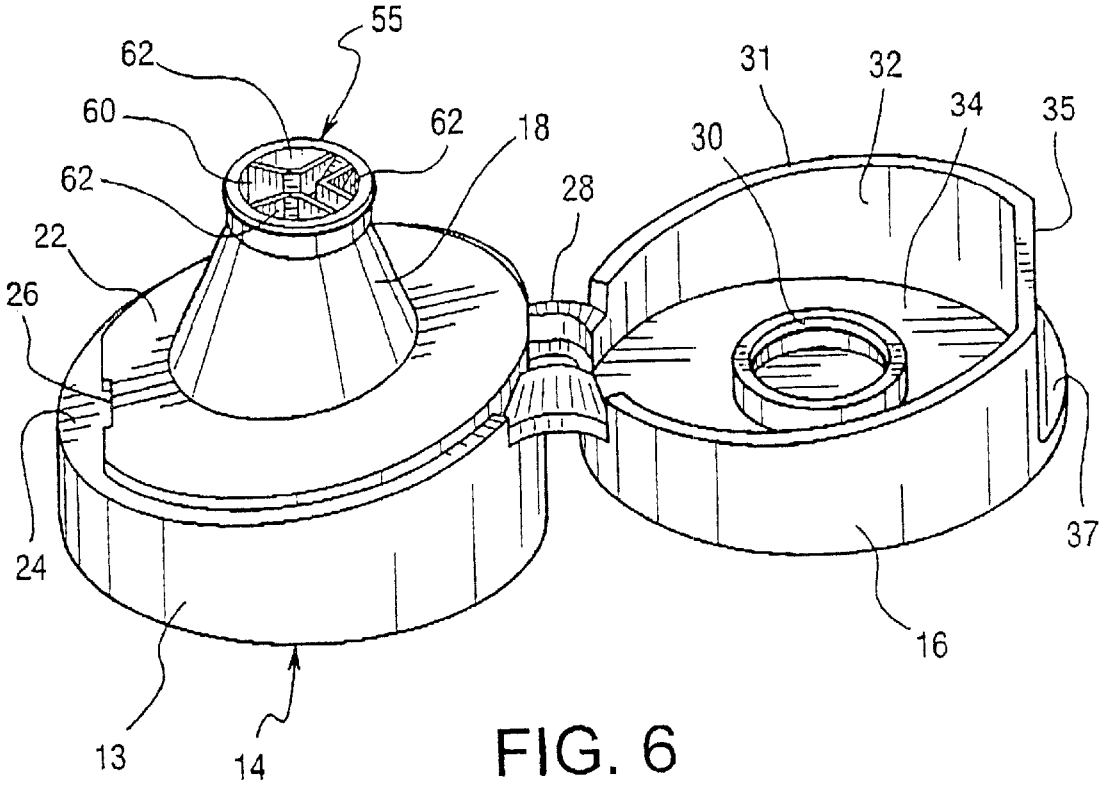
FIG. 6 is a perspective view of the closure of FIG. 1.

FIG. 6 is a perspective view of the closure 14. Shown here is base peripheral wall 13, base deck 22, closure nozzle 18 peripheral base seal area 24 and latch 26. This base is attached to the lid 16 by hinges 28. This lid has a peripheral wall 32, top wall 34 and a closure nozzle seal ring 30. The lid also has a recessed wall 35 to create a ledge 37 for gripping to open the closure. The exit of channels 60 and 62 of the flow director 55 to produce the product flow pattern of FIG. 1 is shown in this view and in FIG. 5.

Figure 7:
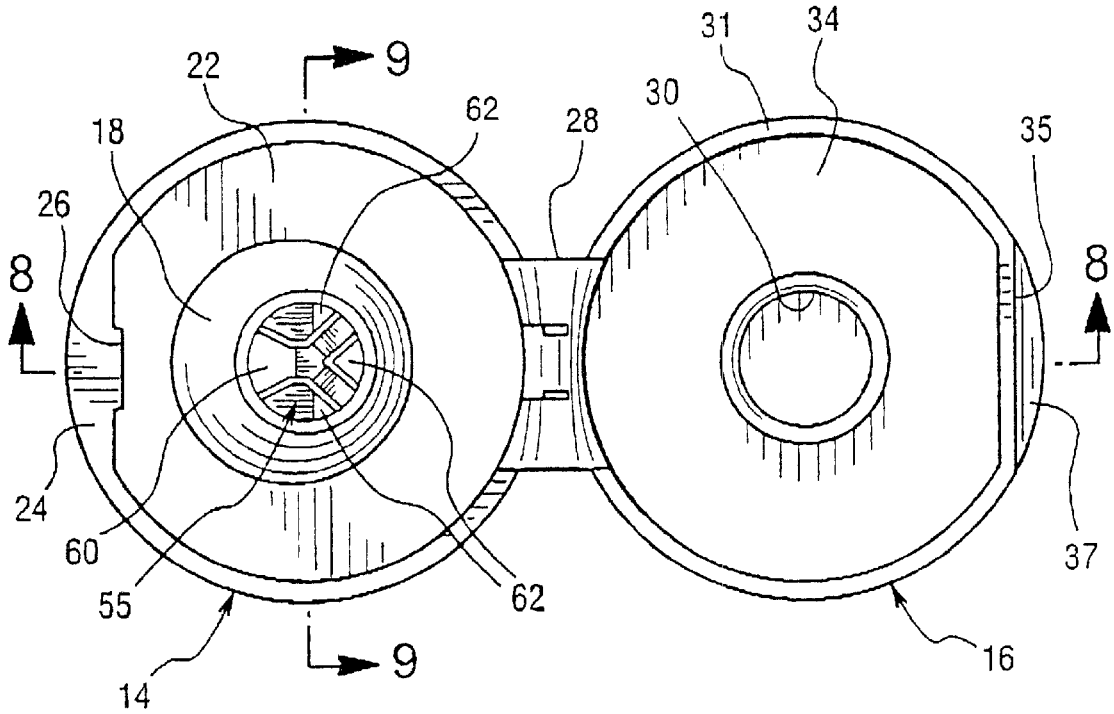
FIG. 7 is a top plan view of the closure of FIG. 6.

FIG. 7 is a top plan view of the closure. This shows the closure in more detail, and particularly the view of FIG. 6. The edge 31 of the lid will mate with seal surface 24 of the base.

Figure 8:
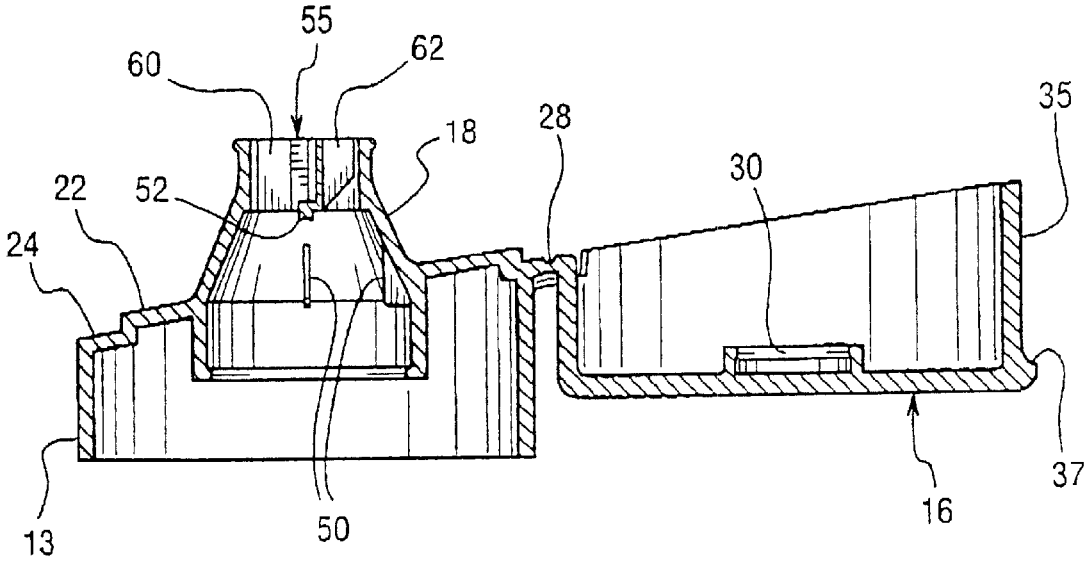
FIG. 8 is a cross-sectional view of the closure of FIG. 7 along line 8—8.

FIG. 8 is a cross-section of the closure of FIG. 7 along line 8—8. This view shows the flow director 55 in more detail. The features of the base and lid have been described in detail in the prior Figures. This view shows the relationship of divider wall 52 to channels 60 and 62 of the flow director 55. "Projection 51 has an interfacing and locking fit with recess 47".

Figure 9:
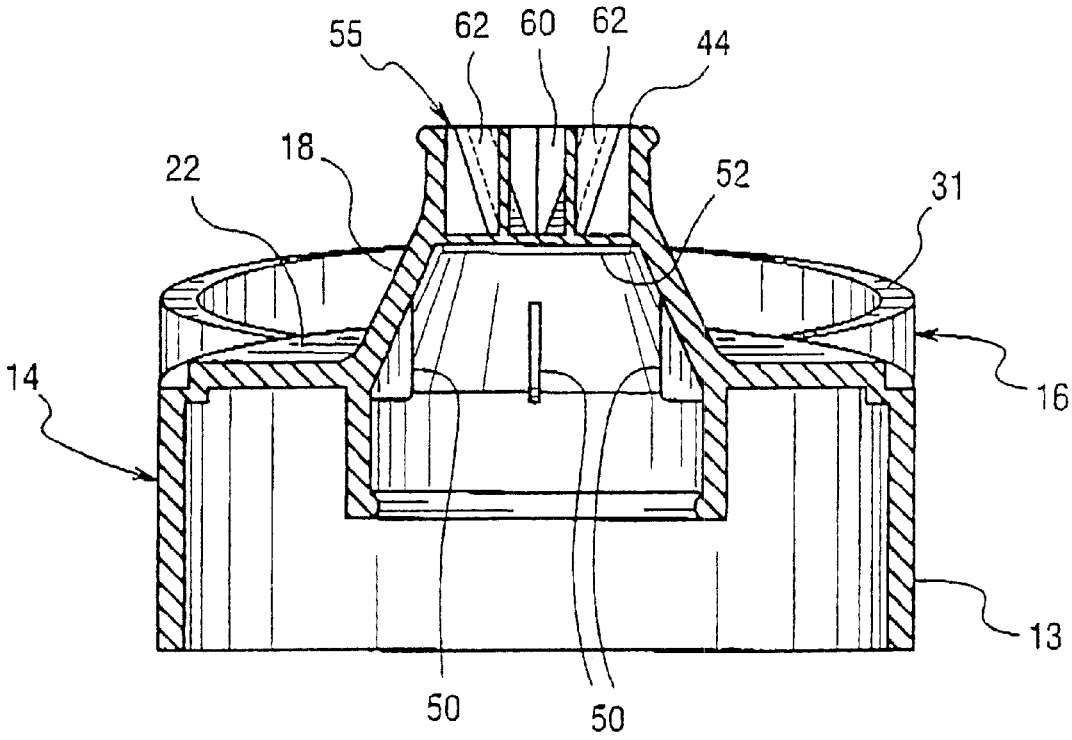
FIG. 9 is a cross-sectional view of the closure of FIG. 7 along line 9—9.
Figure 10:
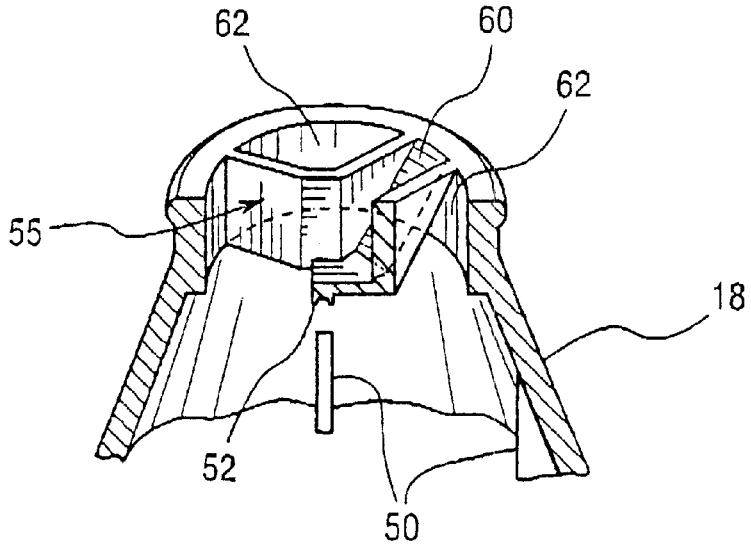
FIG. 10 is a partial view of the nozzle of the closure of FIG. 9.

FIGS. 9 and 10 show the flow director 55 of FIG. 7 in more detail. This shows in flow director with center channels 62.

The tube and the closure can be made from many different materials. The tube can be a laminated or blowmolded tube. The tube shoulder and nozzle can be formed from various plastic materials. The tube can be a multi-ply laminate while the tube shoulder and nozzle are constructed of a single plastic, usually a polyolefin such as polyethylene or polypropylene. The tube closure usually will be injection molded using a polyolefin such as polyethylene or polypropylene. Essentially any injection moldable plastic can be used to make the closures.

A wide range of products can be packaged and dispensed using this tube and closure. The products usually will be incompatible and need to be separated. They also may have different appearances which can be through the use of different colors and/or the incorporation of speckles or encapsulated droplets. As to appearance an objective is to give the product an enhanced visual effect. In the preferred embodiment shown the periphery of the extruded product will have six different segments. When the products are different in color there will be alternating segments of each color.

In use the products 20(*a*) and 20(*b*) are dispensed by opening the lid 16 on the closure 14 and squeezing tube 12 to dispense the product from each chamber of the tube through outlet channels 60 and 62. One product that can be readily dispensed is a dentifrice. After dispensing, and the removal of the dispensed product, the lid is closed to maintain the freshness of the remaining products.

What is claimed is:

1. A closure for a multichamber container comprising a base portion and a lid portion, said lid portion attached to said base portion by a hinge, said base portion having deck portion with a nozzle extending through said deck portion, said nozzle containing a flow director having a plurality of channels, a first set of said plurality of channels in communication with a first chamber of said multichamber container and a second set of said plurality of channels in communication with a second chamber of said multichamber container whereby the product in said first chamber and the product in said second chamber are delivered in a plurality of segments.

2. A closure as in claim 1 wherein said multichamber container has at least two chambers and said first set of said plurality of channels has at least two channels to deliver said product in said first chamber in at least two segments.

3. A closure as in claim 2 wherein said multichamber container has two chambers and said first set of a plurality of channels has more than two channels and delivers the product from said first chamber in at least three segments.

4. A closure as in claim 1 wherein said multichamber container has at least two chambers and said second set of said plurality of channels has at least two channels to deliver said product in said second chamber in at least two segments.

5. A closure as in claim 4 wherein said multichamber container has two chambers and said second set of a plurality of channels has more than two channels and delivers the product from said second chamber in at least three segments.

6. A closure as in claim 1 wherein said closure has an orienting structure on an inner surface of said closure to orient said closure in a set position on said multichamber container.

7. A closure as in claim 6 wherein said orienting structure comprises at least one projection extending from the inner surface of said closure to interact with a recess or said multichamber container.

8. A closure as in claim 1 wherein said base portion of said closure has an attachment structure to attach said closure to said multichamber container.

9. A closure as in claim 8 wherein said attachment structure comprises an interfering locking ridge.

10. A closure as in claim 1 wherein said multichamber container has two chambers and said first set of a plurality of channels has at least two channels to deliver the product from said first chamber in a plurality of segments and said second set of a plurality of channels has at least two channels to deliver the product in said second chamber in a plurality of segments.

11. A multichamber container and closure wherein said multichamber container has at least two longitudinally disposed separate chambers separated by a divider wall extending from a bottom of said container to an exit of said container, a closure attached to the exit of said container and receiving a product from each chamber, said closure comprising a base portion and a lid portion, said lid portion attached to said base portion by a hinge, said base portion having deck portion with a nozzle extending through said deck portion, said nozzle containing a flow director having a plurality of channels, a first set of said plurality of channels in communication with a first chamber of said multichamber container and second set of plurality of channels in communication with a second chamber of said multichamber container.

12. A multichamber container and closure as in claim 11 wherein said multichamber container has at least two chambers and said first set of a plurality of channels has at least two channels to deliver the product from said first chamber in a plurality of segments.

13. A closure as in claim 12 wherein said multichamber container has two chambers and said first set of a plurality of channels has at least two channels to deliver the product from said first chamber in a plurality of segments and said second set of a plurality of channels has at least two channels to deliver the product in said second chamber in a plurality of segments.

14. A multichamber container and closure as in claim 11 wherein said multichamber container has at least two chambers and said second set of said plurality of channels has at least two channels to deliver the product from said second chamber in a plurality of segments.

15. A closure as in claim 14 wherein said multichamber container has two chambers and said first set of a plurality of channels delivers the product from said first chamber in at least three segments.

16. A multichamber container and closure as in claim 11 wherein said closure has an orienting structure on an inner surface of said closure to orient said closure in a set position on said multichamber container.

17. A multichamber container and closure as in claim 16 wherein said orienting structure comprises at least one projection extending from the inner surface of said closure to interact with a recess on said multichamber container.

18. A multichamber container and closure as in claim 11 wherein said base portion of said closure has an attachment structure to attach said closure to said multichamber container.

19. A closure as in claim 18 wherein said attachment structure comprises an interference locking ridge.

20. A closure as in claim 11 wherein said multichamber container has two chambers and said second set of a plurality of channels delivers the product from said second chamber in at least three segments.

* * * * *